US005464487A

United States Patent [19]

Bane

[11] Patent Number: 5,464,487

[45] Date of Patent: Nov. 7, 1995

[54] METHOD OF MAKING A HARDENED BULLET

[75] Inventor: Charles K. Bane, Farmer City, Ill.

[73] Assignee: Bull-X, Inc., Farmer City, Ill.

[21] Appl. No.: 142,187

[22] Filed: Oct. 26, 1993

[51] Int. Cl.[6] ..... C22C 11/00; F42B 7/00

[52] U.S. Cl. ..... 148/706; 148/400

[58] Field of Search ..... 148/706, 400

[56] References Cited

U.S. PATENT DOCUMENTS

| | | | |
|---|---|---|---|
| 1,722,358 | 7/1929 | Seljesaeter | 148/706 |
| 3,759,752 | 9/1973 | Aguire et al. | 148/706 |
| 4,048,922 | 9/1977 | Buljovcic | 102/92.7 |
| 4,332,629 | 6/1982 | McWhinnie | 148/706 |
| 4,528,911 | 7/1988 | DePhillipo et al. | 102/513 |
| 4,753,688 | 6/1988 | Myers | 148/706 |

OTHER PUBLICATIONS

*Metals Handbook,* American Society for Metals, 8th Ed., vol. 1, 1961, p. 1061.

*Metals Handbook,* American Society for Metals, 10th Ed., vol. 2, 1990, pp. 544, 546, 547, 550.

Scovill, *Heat–Treating Cast Bullets,* The Handloaders' Bullet Making Annual, 1990, pp. 18, 19, 82–85.

Venturino, *Reloading,* Handgunning, Nov./Dec. 1993, pp. 24 and 26.

*Primary Examiner*—Upendra Roy

*Attorney, Agent, or Firm*—Lockwood, Alex, Fitzgibbon & Cummings

[57] ABSTRACT

A method of a hardening a solid metal object consisting essentially of lead which has been swaged cold wrought, such as a bullet, and a hardened swaged wrought bullet are disclosed in which the bullet is formed from a lead or lead alloy blank by swaging the blank under high pressure in a forming die, heating the formed wrought bullet to a temperature near but less than the slump temperature of the metal, and then quenching the heated swaged wrought bullet in a liquid to rapidly reduce its temperature. The swaged wrought bullet as thus formed is seamless and has a hardness which exceeds at least 15 Brinell.

13 Claims, 1 Drawing Sheet

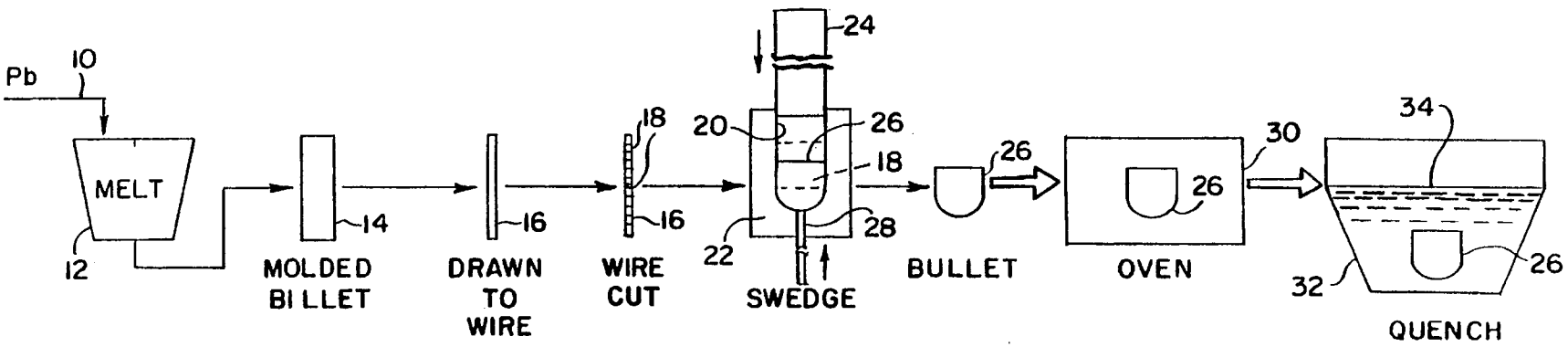
Pb
10
MELT
12
MOLDED BILLET
14
DRAWN TO WIRE
16
WIRE CUT
18
16
20
22
24
26
18
28
SWEDGE
BULLET
26
OVEN
26
30
32
34
26
QUENCH

METHOD OF MAKING A HARDENED BULLET

BACKGROUND AND SUMMARY OF THE INVENTION

The present invention is directed to a method of hardening a solid metal object consisting essentially of lead, such as a bullet, and a hardened swaged bullet.

Traditionally bullets have been formed by the casting of molten lead or lead alloys in molds.

In commercial production, when the solidified cast bullet is released from the mold it is typically cooled at ambient temperature in air. As a result, the cast lead or lead alloy bullets rapidly lose any hardness properties which they may have had upon release from the mold during the cooling. Thus, by the time they are to be fired they are quite soft. Unless these cast bullets are jacketed with a harder metal such as copper, this softness limits the muzzle velocity at which the softened cast bullets may be fired if barrel leading is to be maintained at acceptable levels and accuracy is to be maximized.

This softness problem has been alleviated to some extent by commercial producers of cast bullets by the use of so-called "6-2" lead alloys in which the alloy is an alloy of 6 wt % antimony and 2 wt % tin with the remainder being lead. The relatively high amount of antimony in the alloy does impart some increased hardness to the commercially cast bullets. However, these somewhat increased hardness levels are still insufficient for firing at higher muzzle velocities unless the bullet is jacketed.

Another disadvantage in the prior commercial casting procedures is that the production rate is substantially limited. At least one reason for this is that the bullets must be held in the mold until their temperature is below the slump temperature to insure that their molded shape does not change following release from the mold. Thus, the maximum current commercial production rate of cast bullets is only about 3500 bullets per hour from an eight mold, two cavity per mold machine.

In order to achieve higher muzzle velocities in cast bullets without resorting to expensive jacketing, handloaders occasionally have resorted to the heat hardening of the cast bullets, either bullets which the handloader has personally cast or bullets which have been obtained commercially. This hardening has been accomplished either by dropping the just cast hot bullet into water to quench it, or by reheating a previously cast bullet to just below its slump temperature and then quenching it. This tends to freeze the molecular structure and alignment at the heated alignment of .the molecules in which the hardness is greater.

The handloader casting and/or hardening procedures also have disadvantages. One obvious disadvantage is that the production rate is substantially less than the commercial procedures which are already relatively low. Where quenching is to be done of bullets dropped directly from the casting mold, precise timing and close temperature control are required to avoid significant variations in hardness which could result in hardnesses of only a fraction of the maximum possible hardness. Moreover, the presence of quenching water in close proximity to the molten lead in the melting ladle or pot is dangerous because if even a few drops of water accidently contact the molten lead, the lead may explode from the ladle.

Cast bullets, whether commercially or handloader produced, also suffer several additional disadvantages. One such disadvantage is the fact that the cast bullet has a seam from the molding equipment. Such seams reduce the aerodynamic qualities of the bullet and, therefore, reduce the bullet's accuracy if it is to be fired in an unjacketed condition.

Another disadvantage of the casting method is that an alloy is typically used which contains a considerable quantity of tin as previously mentioned. Tin is added to enhance the flowability of the molten alloy in the mold, and if tin is not included, the resulting molded product is usually inferior. However, the tin tends to reduce the hardness of the product and the effectiveness of the antimony which has been included for that purpose. Thus, the level of antimony must be increased to compensate for the loss of hardness. However, both the antimony and the tin substantially increase the bullet cost because they are metals which are considerably more expensive than lead.

In order to overcome at least some of the disadvantages inherent in the casting methods and products formed thereby, stamping or swaging procedures for the manufacture of bullets came into existence around the turn of the century. In the swaging procedure a drawn lead or lead alloy wire is cross-sectioned to form a number of small blanks. One of these blanks is then placed in a swaging die which has a cavity of the shape of the finished bullet. The blank is then punched with a ram punch under substantial pressure so that it cold flows in the cavity to assume the shape of the bullet. The finished, shaped wrought swaged bullet is then removed from the forming die. No further processing of the bullet other than preparing it for lubrication and lubricating it is necessary if the bullet is to be used at low muzzle velocities. Where the swaged wrought bullets are to be used at higher muzzle velocities, the swaged bullets typically have been jacketed or plated with copper or the like to increase their outer hardness.

Swage forming of bullets offers several distinct advantages over the casting of bullets. One advantage is that the swaged wrought bullet is seamless. Another distinct advantage is that the swaging process is capable of production rates which greatly exceed those of casting. In swaging up to as many as about 20,000 bullets per hour can be commercially produced from a single die cavity. Still another advantage is that tin which is needed for flowability of the molten lead alloy in the casting process can be eliminated in the swage forming process because flowability is not a concern. Thus, the increased expense and potential reduction in hardness which might be otherwise experienced with the addition of tin is eliminated in swaged bullets, and the levels of antimony may also be reduced.

In a jacketed bullet hardness of the lead is not of particular concern from the standpoint of leading because the jacketing, for example copper, effectively defines the surface hardness of the bullet during firing. However, in an unjacketed bullet in which the lead or lead alloy is in direct contact with the rifling in the barrel of the firearm, hardness is a concern. The lower the hardness, the greater the amount of leading that is deposited in the lands and grooves of the firearm rifling. Increased leading reduces the accuracy. Moreover, as the muzzle velocity of the ammunition increases, the leading also increases.

As previously mentioned, leading is a function of the muzzle velocity of the bullet. The United States Practical Shooting Association has established regulations for competition matches which are based on power factor. Those regulations define the power factor by the formula:

$$PF = \frac{W \times V}{1000}$$

where PF=power factor, W=bullet weight in grains (gr), and V=muzzle velocity in feet per second (fps). For major power factor competition events those regulations currently set a minimum for the major power factor of 175. The ammunition of one who competes under those regulations must equal or exceed that major power factor.

Leading of an unjacketed bullet typically occurs when the muzzle velocity is about 900 fps or more. Typical handgun bullet weights are in the range of about 95–230 gr, and weights of about 115 gr are currently popular because the lighter the bullet, the less the recoil. Thus, it will be seen that where the weight of the bullet is the heavier 230 gr, leading is not a major concern because a muzzle velocity of only about 760 fps is needed to meet the 175 major power factor requirement. However, the muzzle velocity of a 95 gr bullet would be about 1850 fps, and of the currently popular 115 gr bullet would be about 1525 fps. These muzzle velocities will result in excessive leading with a typical unjacketed swage wrought lead bullet.

In the present invention a process for the hardening of a lead or lead alloy swaged wrought solid object, such as a bullet, and a hardened swaged wrought bullet are disclosed in which all of the advantages of a swaged bullet are realized, in which jacketing with its increased cost may be eliminated, but in which lighter bullets may be fired at high muzzle velocities which satisfy the foregoing major power factor requirements without unacceptable leading of the rifling of the firearm and loss of accuracy. Moreover, the tendency of jacketed bullets to increase barrel erosion and shorten the life of the barrel is substantially reduced because the need for jacketing is eliminated.

In one principal aspect of the present invention, a method of hardening a solid metal object which has been swaged cold wrought formed under pressure and in which the metal consists essentially of lead includes heating the swaged cold wrought solid metal object to a temperature near but less than the slump temperature of the metal, and quenching the heated object in a liquid to rapidly reduce its temperature.

In another principal aspect of the present invention, a method of making a hardened swaged wrought bullet includes heating a swaged wrought bullet which has been swage formed under high pressure in a swage forming die to a temperature near but less than the slump temperature of the metal, and quenching the heated wrought bullet in a liquid to rapidly reduce its temperature.

In still another principal aspect of the present invention, the metal is primarily lead, and the swaged wrought object or bullet is heated to about 450° F. for at least about 30 minutes.

In still another principal aspect of the present invention, the quenching liquid is water.

In still another principal aspect of the present invention, a bullet comprises an unjacketed swaged wrought metal bullet having a hardness of at least about 15 Brinell.

In still another principal aspect of the present invention, the metal is lead or an alloy of lead and antimony.

In still another principal aspect of the present invention, the amount of antimony in the metal alloy does not exceed about 5 wt %, and preferably about 3.5 wt % of the total weight of the metal.

In still another principal aspect of the present invention, the metal is substantially free of tin.

In still another principal aspect of the present invention, the bullet is seamless.

These and other objects, features and advantages of the present invention will be more clearly understood through a consideration of the following detailed description.

BRIEF DESCRIPTION OF THE DRAWING

In the course of this description reference will frequently be made to the attached drawing the sole figure of which is a schematic depiction of the principal steps in forming a swedged wrought bullet and hardening it in accordance with the preferred embodiment of the invention.

DESCRIPTION OF THE PREFERRED EMBODIMENT

With reference to the drawing, the metal of which the bullets of the invention are to be formed is introduced at 10 to a melting pot or ladle 12 for melting the metal. The metal primarily consists of lead and is preferably an alloy of lead and antimony, as will be discussed in further detail to follow.

The molten metal is then passed from the melting pot 12 as shown by the solid horizontal arrow to a casting mold which molds it into billets 14 for ease of future handling. These billets 14 are typically air cooled after molding and thereafter may be stored for future use, or in the alternative they may be used immediately in the manufacture of bullets according to the invention.

The molded billets 14 have a relatively high degree of hardness, particularly where some level of antimony is present in the metal. However, this hardness will substantially diminish on cooling.

At the time a billet 14 is to be used in the manufacture of bullets, it is first drawn into a wire 16 which has a diameter which approximates the caliber of the bullet to be made. The work which is imparted to the metal during drawing into the wire 16 further reduces the hardness of the metal to only nominal levels. After drawing, the wire 16 is then cross-sectionally cut into a plurality of plug-like blanks 18. These blanks likewise may be stored for future use or may be used immediately in the manufacture of the bullets.

In order to form a bullet, a blank 18, as shown in dot and dash in the drawing, is placed into a forming cavity 20 of a swage forming die 22. A ram punch 24 then enters the cavity 20 in the direction of the vertical arrow shown in the drawing to exert a substantial pressure on the blank 18 which causes the relatively malleable metal to cold flow into the unfilled spaces of the cavity and assume the configuration of the shape of the bullet 26. The forming ram punch 24 is then withdrawn from the cavity, and the swaged wrought bullet 26 is ejected from the cavity 20 by an ejection punch 28 which is moved into the cavity 20 in the direction shown by the vertical arrow in the drawing.

At this point, the cutting of the wire 16 into blanks 18 and the work imparted to the blanks 18 in the swaging procedure typically further reduce the hardness of the metal of the now formed bullet 26.

The swaging procedures thus far described and shown by the solid horizontal arrows in the drawing are the typical procedures which have been employed to date in the manufacture of swaged wrought bullets. As previously discussed, the swaging process has distinct advantages over the earlier casting processes including a substantial increase in production rates, the swedged wrought bullet is seamless, and the metal of the bullet need not include any tin in its formulation for flowability because flowability is not a concern in the swaging process.

These prior swaged bullets were acceptable in an unjacketed condition for low muzzle velocity ammunition, e.g. below about 900 fps. Where they were to be utilized in higher muzzle velocity ammunition, they have been jacketed or coated with a copper or other metal jacket to prevent unacceptable leading or flash by/gas cutting under higher muzzle velocity conditions exceeding 900 fps.

It has been discovered in the present invention that the considerable cost of jacketing or coating of such swedged wrought bullets in order to adapt them for higher muzzle velocity ammunition may be avoided by reheating the cold swedged wrought bullet 26 after it has been cold formed to a temperature near but less than the slump temperature of the metal, and then rapidly quenching it. The heating of this cold formed, wrought bullet causes the metal molecules to realign, and when the hot bullet is then rapidly quenched, the metal molecules will be frozen in their hardened condition.

As shown in the drawing, at any time after the bullet 26 has been swage cold formed, it is introduced to a heating chamber, for example a forced air oven 30, as shown by the hollow arrow in the drawing. The melting temperature of lead is approximately 622° F. (328° C). However, the bullet should not be heated to its melting point because a change in shape would be detrimental. It should be heated, however, to slightly below the slump temperature. Again in the case of lead or alloys of lead having no more than 5 wt % antimony, it has been found that a temperature of about 450° F. (about 220° C.) for at least about 30 minutes is adequate to achieve a sufficient and uniform temperature without a change in shape but which will result in a hardness of at least 15 Brinell upon quenching.

After this heating step, the bullet 26 is rapidly quenched, as shown by the hollow arrow in the drawing. This quench is preferably accomplished by dropping it into a container or tank 32 containing a quenching liquid 34. The quenching liquid is preferably water which may be at substantially ambient temperature. The quenching liquid may also include a lubricant for coating the bullet 26 or the quenched bullet may be submitted to a separate subsequent lubricant coating step if desired.

It has been discovered that by submitting the swedged wrought bullet 26 to the foregoing heating and quenching steps, the hardness of the bullet may be substantially increased to a hardness of 25–30 Brinell where the metal of the bullet is an alloy of lead and about 3.5 wt % antimony. A reduction in the amount of antimony from this amount will result in some reduction in the hardness, but even when the antimony is eliminated altogether, hardnesses may be substantially increased in the swaged wrought bullets of the invention.

It has also been discovered that the inclusion of percentages of antimony higher than 3.5 wt % do not appreciably effect any further substantive increase in the hardness. Thus, the as much as 6 wt % antimony which was typically utilized in the "6-2" metals employed in the prior casting methodology is unnecessary in the present invention.

The swaged wrought bullets of the present invention will have a hardness which is more than sufficient for firing without jacketing and unacceptable leading at substantially higher muzzle velocities in excess of 900 fps, and at muzzle velocities that meet the 175 major power factor requirement for even the lighter handgun bullet weights. Moreover, the hardnesses of the swaged wrought bullets of the invention maintain satisfactory hardness levels over substantial periods of time.

The following example is set forth to further illustrate the preferred embodiment of the invention. In the example unjacketed swaged wrought bullets were prepared in accordance with the invention and were tested for hardness.

EXAMPLE 38 caliber swaged wrought bullets manufactured by Bull-X, Inc. were heat treated in an open air furnace at about 450° F. for the times set forth below and were then promptly quenched in water at ambient temperature. Following quenching, the Brinell hardnesses of at least 25 of the bullet samples were tested with a Rockwell machine in accordance with ASTM Standard E10-84 using a 100 kg load and an M scale ball of 6.35 mm diameter. The duration of the heating and the Brinell hardness readings were as follows:

| Heating Time (min.) | Brinell Hardness (range) |
|---|---|
| 5 | 19.6–21.3 |
| 10 | 25.5–28 |
| 20 | 24.3–25.5 |
| 30 | 28–29 |

After 8 days, 1 ½ months and 2 months, hardness tests were again performed on these samples and these tests revealed that the hardness was essentially unchanged.

At least 25 of the samples which were heated for 5 and/or 10 minutes and then quenched as described above also were sectioned, ground, polished and hardness tested both at the surface and the core. These tests revealed that the hardness was essentially uniform throughout.

The samples which had been hardened as described were also analyzed for metal content and had the following metal content:

| metal | wt. % |
|---|---|
| Copper | 0.038 |
| Arsenic | 0.16 |
| Antimony | 3.0 |
| Tin | 0.25 |
| Zinc | 0.0001 |
| Cadmium | 0.0001 |
| Nickel | <.0001 |
| Bismuth | 0.018 |
| Silver | 0.0038 |
| Tellurium | 0.0015 |
| Sulfur | 0.0005 |
| Iron | <.0001 |
| Lead | Balance |

It can be seen from the above example that the hardened swaged wrought bullets of the present invention are capable of use in their unjacketed form with ammunition loads of substantially higher muzzle velocities exceeding 900 fps, and in loads having the power factor and bullet weights previously discussed without unacceptable leading. Thus, the cost of jacketing is avoided as well as cost of inclusion of tin or increased levels of antimony.

It will be understood that the preferred embodiment of the present invention which has been described is merely illustrative of the principles of the present invention. Numerous modifications may be made by those skilled in the art without departing from the true spirit and scope of the invention.

What is claimed is:

1. A method of making a hardened swaged wrought bullet comprising:

heating a swaged wrought metal bullet which has been swage formed under high pressure in a swage forming die to a temperature near but less than the slump temperature of the metal; and quenching the heated wrought bullet in a liquid to rapidly reduce its temperature to harden the wrought bullet.

2. The method of claim 1, wherein the metal is lead.

3. The method of claim 1, wherein the metal is an alloy of lead and antimony.

4. The method of claim 1, wherein the metal is primarily lead, and the bullet is heated to about 450° F.

5. The method of claim 1, wherein the quenching liquid is water.

6. The method of claim 1, including the step of forming the swaged wrought bullet from a metal blank by swedging the blank under the high pressure in the forming die.

7. The method of claim 1, wherein the hardness of the bullet after quenching is at least about 15 Brinell.

8. The method of claim 3, wherein the alloy is substantially free of tin.

9. The method of claim 3, wherein the amount of antimony in the alloy does not exceed about 5 wt % of the total weight of the metal.

10. The method of claim 4, wherein the metal is an alloy of lead and antimony.

11. The method of claim 4, wherein the bullet is heated for at least about 30 min.

12. The method of claim 9, wherein the amount of antimony in the alloy does not exceed about 3.5 wt % of the total weight of the metal.

13. The method of claim 11, wherein the metal is an alloy of lead and antimony.

* * * * *